United States Patent [19]

Bremer

[11] 3,930,455

[45] Jan. 6, 1976

[54] BOAT HULL CONSTRUCTION

[76] Inventor: Harry Bremer, P.O. Box 488, Elkhart Lake, Wis. 53020

[22] Filed: Sept. 19, 1974

[21] Appl. No.: 507,260

[52] U.S. Cl. ..... 114/56; 9/6 P; 114/66.5 R

[51] Int. Cl.[2] ..... B63B 1/20

[58] Field of Search ..... 114/56, 61, 62, 63, 66.5 R, 114/66.5 S, 66.5 F, 70; 9/6 P, 6 M, 6 R; 115/39

[56] References Cited

UNITED STATES PATENTS

| | | | |
|---|---|---|---|
| 2,938,490 | 5/1960 | Martin | 114/56 |
| 3,077,851 | 2/1963 | Bamberger | 114/62 |
| 3,191,572 | 6/1956 | Wilson | 114/61 |
| 3,226,739 | 1/1966 | Noe | 114/56 |
| 3,259,092 | 7/1966 | Kara | 114/56 |
| 3,600,733 | 8/1971 | Lippisch | 9/6 P |

*Primary Examiner*—Trygve M. Blix
*Assistant Examiner*—Charles E. Frankfort
*Attorney, Agent, or Firm*—Andrus, Sceales, Starke & Sawall

[57] ABSTRACT

A boat hull construction having a bottom formed with a central longitudinal surface and side surfaces spaced on either side of the central surface. Both the central surface and the side surfaces are flat in a cross sectional direction, and the side surfaces are separated from the central surface by upwardly arched channels. The three parallel flat surfaces enable the boat to plane at lower speeds and provide improved lateral stability.

6 Claims, 6 Drawing Figures

BOAT HULL CONSTRUCTION

BACKGROUND OF THE INVENTION

Flat bottomed hulls are considered to have good planing characteristics due to the fact that there is a minimum amount of wetted surface and as a result there is a minimum drag as the speed is increased. However, flat bottomed hulls lack stability on turning and also have a tendency to produce a rough ride in choppy water.

V-bottom hulls are generally formed with a relative deep V at the bow which flattens out toward the stern. The V-hull has the advantage of being able to cut into heavy seas, although as the V cuts down into the water the water is displaced upwardly along the V and has a tendency to slap against the bottom of the hull. Furthermore, the V-bottom hull lacks lateral stability particularly in the forward areas.

More recently the tri-hull has become more popular in smaller boats. The tri-hull consists of a central V along with V's of lesser depth along the side edges of the hull. The tri-hull provides a substantial increase in lateral stability, particularly in the forward areas, but acts to increase the amount of wetted surface so that the planing characteristics of the tri-hull are adversely effected.

Various other types of modified V-hulls or tri-hulls have been used in the past in an attempt to obtain better planing characteristics or to increase the stability of the hull.

SUMMARY OF THE INVENTION

The invention relates to an improved boat hull construction which provides better planing characteristics as well as greater stability. In accordance with the invention, the bottom of the hull is formed with a central longitudinally extending flat surface which extends from the stern toward the bow. The central surface is flat in a lateral or cross sectional direction, through its length. In addition, the bottom is provided with a pair of side surfaces which are parallel to the central surface and are separated from the central surface by upwardly arched channels. Each side surface is flat in a lateral or cross sectional direction throughout its length, and at any cross sectional location, the side surfaces lie in a common plane.

The portion of the central surface located adjacent the stern is slightly concave in a longitudinal direction, while the side surfaces are slightly convex in a longitudinal direction.

The three parallel surfaces act in a manner similar to water skis and provide improved planing characteristics enabling the boat to plane at substantially lower speeds.

In addition, the side surfaces on the bottom of the hull provide excellent lateral stability for the hull, resisting tipping even when a substantial weight is applied to the gunwale.

The hull construction also provides improved turning characteristics which minimizes skidding during high speed turns and eliminates the problem of cavitation of the propeller which frequently occurs during high speed skids.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

Figure 1:
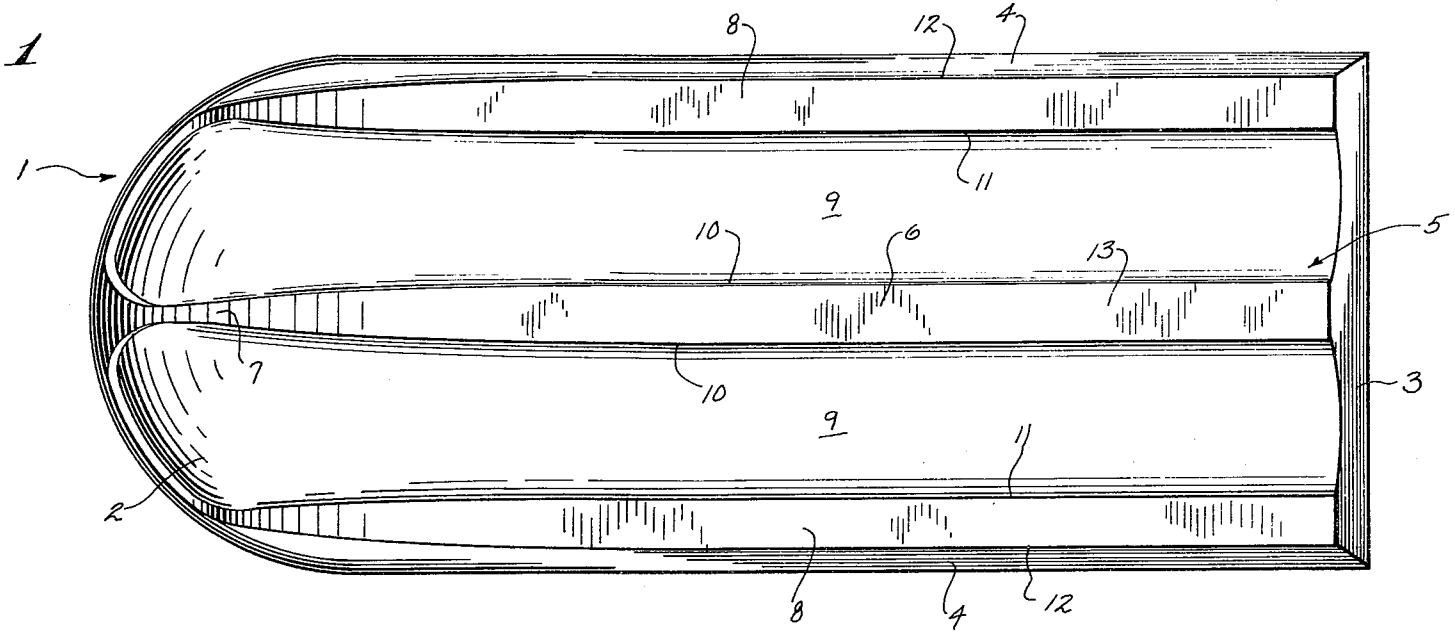
FIG. 1 is a bottom view of the boat hull construction of the invention.

The drawings illustrate a boat hull 1, which can be preferably formed as a hollow shell by molding reinforced plastic material, such as a mixture of a thermosetting resin and glass fibers. In general, the hull is provided with a curved bow 2, and a generally squared off stern 3. Tapered sides 4 and a bottom 5 are connected to the stern and merge into the bow. The drawings illustrate the side surfaces 4 being relatively straight in a fore-and-aft direction, but it is contemplated that the sides 4 can be bowed or convex.

In accordance with the invention, the bottom 5 is formed with a central, longitudinally extending surface 6 which extends from the stern toward the bow. The surface 6 is generally flat in a lateral or cross sectional direction, as best illustrated in FIGS. 3–6, and the surface 6 has a substantially constant width from the stern of the boat to a location at the bow. As shown in FIG. 1, the forward portion 7 of surface 6 at the bow is tapered inwardly to provide a lesser width, although the taper is not necessary to the invention. However, it is important that the portion of the surface 6 extending from the stern 3 to the bow 2 have a substantially constant width throughout its length so that it will function in the manner similar to that of a water ski.

In addition, to the central surface 6, the bottom 5 is provided with a pair of side surfaces 8 which are parallel to the central surface 6. As in the case of the central surface, the side surfaces 8 are generally flat in a lateral or cross-sectional direction and have a substantially constant width from the stern to a location adjacent the bow. The surface 6 has a substantially greater width than the width of the side surfaces 8.

Figure 3:
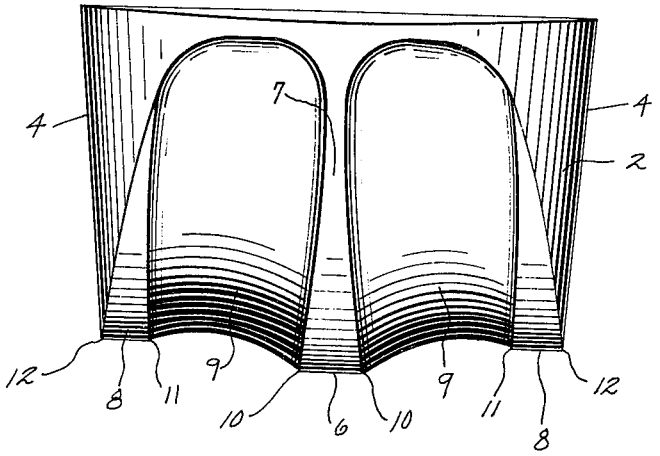
FIG. 3 is an end view of the bow of the hull.
Figure 4:
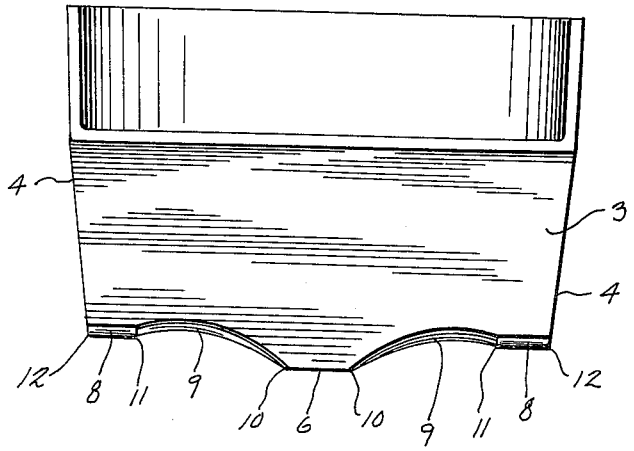
FIG. 4 is an end view of the stern of the hull.
Figure 5:
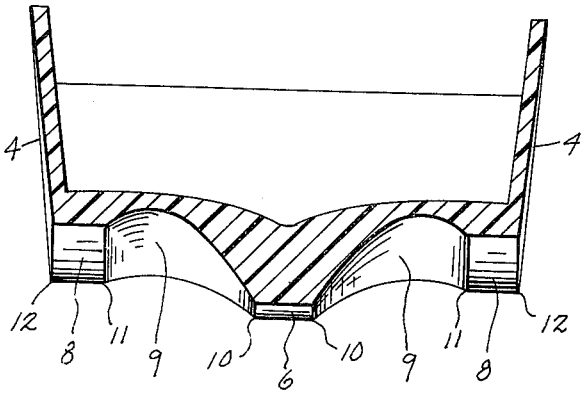
FIG. 5 is a section taken along line 5—5 of FIG. 2.
Figure 6:
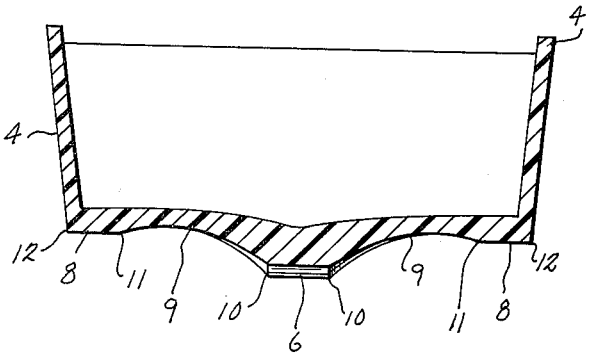
FIG. 6 is a section taken along line 6—6 of FIG. 2.

Separating the central surface 6 from the side surfaces 8 are the upwardly arched channels 9. The channels 9 have a greater depth in the area toward the bow as shown in FIG. 3, and have a lesser depth in the area adjacent the stern as shown in FIG. 4. The central surface 6 is bordered by the relatively sharp, parallel side edges 10, and similarly the side surfaces 8 are bordered by the relatively sharp side edges 11 and 12.

The channels 9 have a substantially constant lateral width from the stern to the bow and thus a vertical plane passing through the edges 10 is parallel to a vertical plane passing through the edges 11 of the side surfaces.

Figure 2:
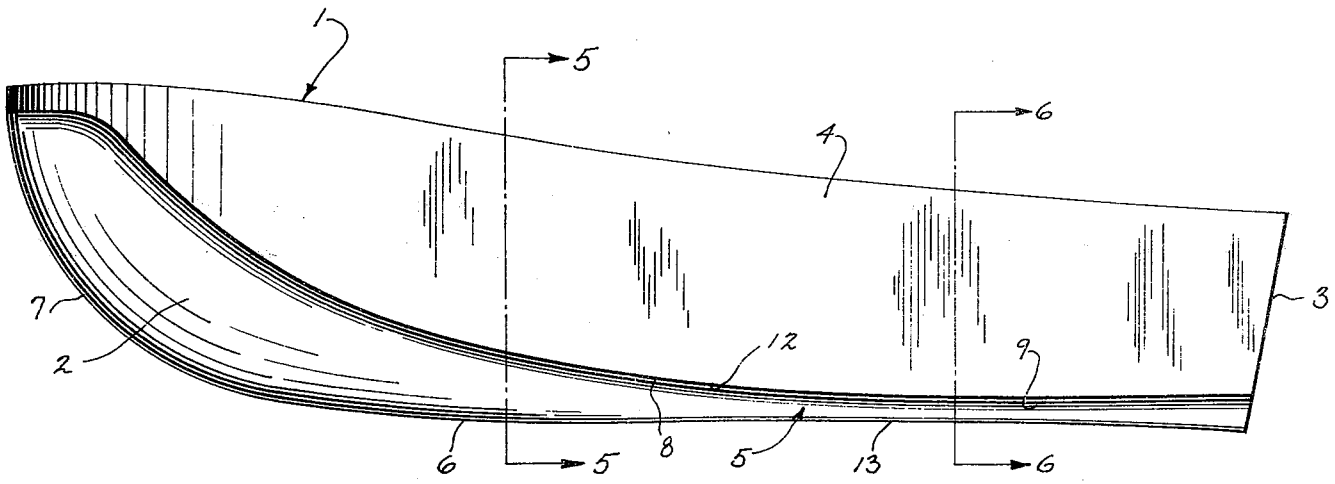
FIG. 2 is a side elevation of the boat hull.

While the central surface 6 is generally flat in a lateral direction, the stern portion of the central surface 6 is provided with a slight concavity in a longitudinal direction, as indicated by 13. On the other hand, the side surfaces 8 are generally convex in a longitudinal direction as best illustrated in FIG. 2.

The three flat parallel surfaces 6 and 8 act to combine the best characteristics of a flat bottom full, a V-hull and a tri-hull. The three surfaces 6 and 8 act similar to water skis and minimize the amount of wetted surface, thereby reducing the drag and enabling the boat to plane at substantially lower speeds. In addition, the upwardly arched channels 9 provide a lift effect, which in combination with the flat surfaces 6 and 8, provides the improved planing characteristics. As the hull moves into the water, the surfaces 6 and 8 being flat will displace the water laterally outward from the respective surface in a generally horizontal direction and this water flow along with the air moving through the channels will provide a lifting effect to improve the planing characteristics of the hull.

The hull has improved turning capabilities because the relatively sharp edges 10 and 11 will act to dig into the water during a turn and prevent the hull from skidding. Thus, the hull provides a greater number of digging edges during a turn than either the normal V-hull or tri-hull, with the result that the stability is increased and the turning characteristics are improved.

The hull construction also has improved lateral stability due to the flat side surfaces 8 which extend from the stern forwardly toward the bow, enabling the hull to resist tipping even when a substantial weight is applied in the gunwale area. This feature also improves the buoyancy of the hull, permitting the hull to carry greater loads.

Various modes of carrying out the invention are contemplated as being within the scope of the following claims particularly pointing out and distinctly claiming the subject matter which is regarded as the invention.

I claim:

1. A modified deep V boat hull construction, comprising a bottom having a central surface extending longitudinally from the stern toward the bow, said central surface being generally flat in a cross sectional direction, said bottom having longitudinally extending side surfaces spaced laterally on either side of said central surface, said side surfaces being generally flat in a cross sectional direction, at any cross sectional plane through the hull the line of intersection of each of said side surfaces and said plane being horizontal and the line of intersection of said central surface and said plane being horizontal and at a lower level than said first named lines of intersection, and said hull having longitudinally extending upwardly arched curved channels connecting said central surface with each side surface, said channels having a substantially uniform lateral width from the stern of the hull toward the bow.

2. The boat hull construction of claim 1, wherein the central surface has a substantially uniform lateral width from the stern to a location adjacent the bow and said side surfaces each have a substantially uniform lateral width from the stern to a location adjacent the bow.

3. The boat hull construction of claim 1, wherein the portion of the central surface disposed adjacent the stern has a slightly concave configuration in a stern-to-bow direction and the side surfaces have a slightly convex configuration in a stern-to-bow direction.

4. The boat hull construction of claim 1, wherein the central surface has a greater lateral width than the side surfaces.

5. A modified deep V boat hull construction comprising a bottom having a central longitudinally extending generally V-shaped keel with the bottom of the keel terminating in a laterally flat central surface, said bottom having longitudinally downwardly extending generally V-shaped side ridges spaced laterally on both sides of the central keel, said side edges terminating in laterally flat side surfaces, at any vertical cross sectional plane through the hull said side surfaces being generally parallel to each other and generally parallel to said central surface and said central surface being at a lower level than said side surfaces, and said hull having longitudinally extending upwardly arched continuously curved channels connecting said keel with said side ridges, each of said channels having a greater lateral width than said central surface and having a greater lateral width than the individual side surfaces.

6. The boat hull construction of claim 5, wherein said central surface has a substantially uniform width in a lateral direction and said side surfaces each having a substantially uniform width in a lateral direction, said central surface having a greater width than said side surfaces.

* * * * *